US006293719B1

(12) United States Patent
Ohba

(10) Patent No.: US 6,293,719 B1
(45) Date of Patent: Sep. 25, 2001

(54) CARTRIDGE TYPE BAR-SHAPED COSMETIC MATERIAL DELIVERY CONTAINER

(75) Inventor: Atsushi Ohba, Tokyo (JP)

(73) Assignee: Suzuno Kasei Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/509,018

(22) PCT Filed: Jul. 27, 1999

(86) PCT No.: PCT/JP99/04008

§ 371 Date: Jun. 1, 2000

§ 102(e) Date: Jun. 1, 2000

(87) PCT Pub. No.: WO00/05992

PCT Pub. Date: Feb. 10, 2000

(30) Foreign Application Priority Data

Jul. 29, 1998 (JP) ..... 10-227548

(51) Int. Cl.[7] ..... B43K 21/02
(52) U.S. Cl. ..... 401/59; 401/98
(58) Field of Search ..... 44/98, 59, 60, 44/61

(56) References Cited

U.S. PATENT DOCUMENTS

| | | | | |
|---|---|---|---|---|
| 1,862,271 | * | 6/1932 | Levy | 401/59 |
| 1,953,910 | * | 4/1934 | Parkin | 401/59 |
| 2,033,333 | * | 3/1936 | Fitz Gerald | 401/59 |

FOREIGN PATENT DOCUMENTS

| | | |
|---|---|---|
| 62-69935 | 5/1987 | (JP) . |
| 1-101420 | 7/1989 | (JP) . |
| 9-70316 | 3/1997 | (JP) . |
| 10-116 | 1/1998 | (JP) . |

* cited by examiner

*Primary Examiner*—David J. Walczak
(74) *Attorney, Agent, or Firm*—Rabin & Berdo, P.C.

(57) ABSTRACT

A cartridge type container for feeding a stick type cosmetic material includes a cartridge 2 having a stick type cosmetic material built-in, a container body 4 which can easily be attached to or detached from the cartridge 2, and a cap 3 which is composed of a cylinder 37 and a lid 31. The cylinder 37 is attached to a periphery of the container body 4 in such a manner that the cylinder 37 can slide in an axial direction and never comes off. The lid 31 is installed in such a manner that it can open and close an upper end opening of the cylinder 37. Further, the stick type cosmetic material can be advanced and returned by synchronously rotating the container body 4 and the cylinder 37.

8 Claims, 5 Drawing Sheets

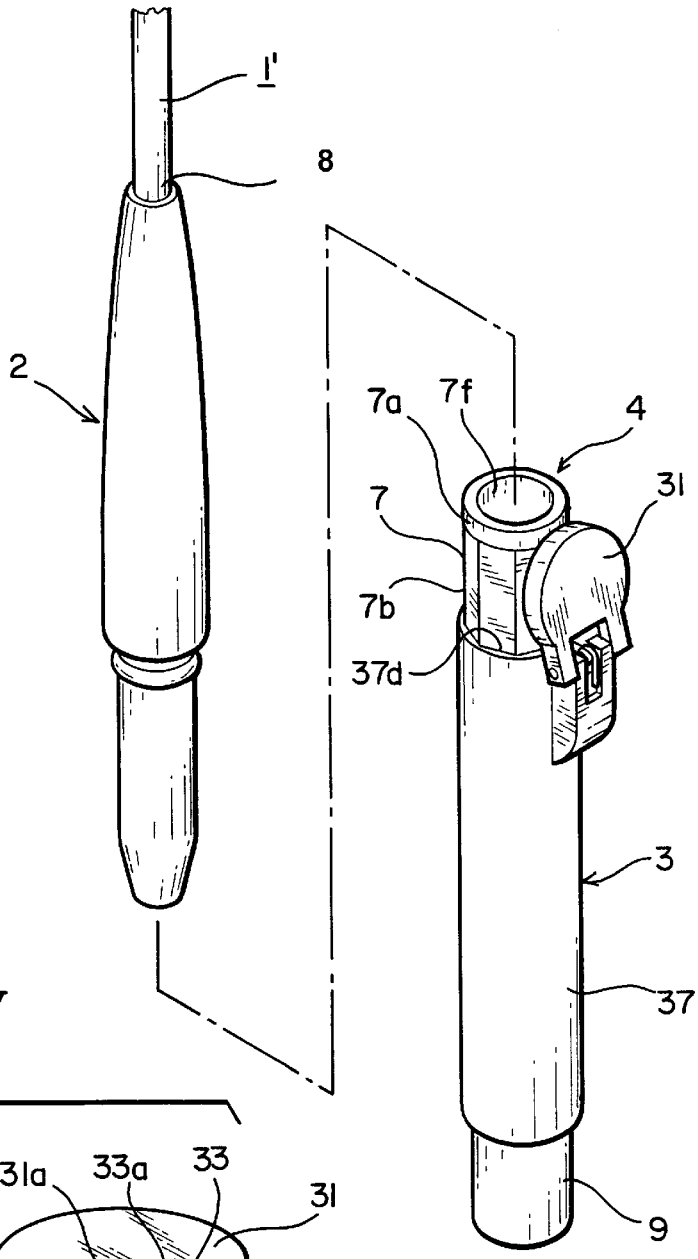
FIG. 1
FIG. 4
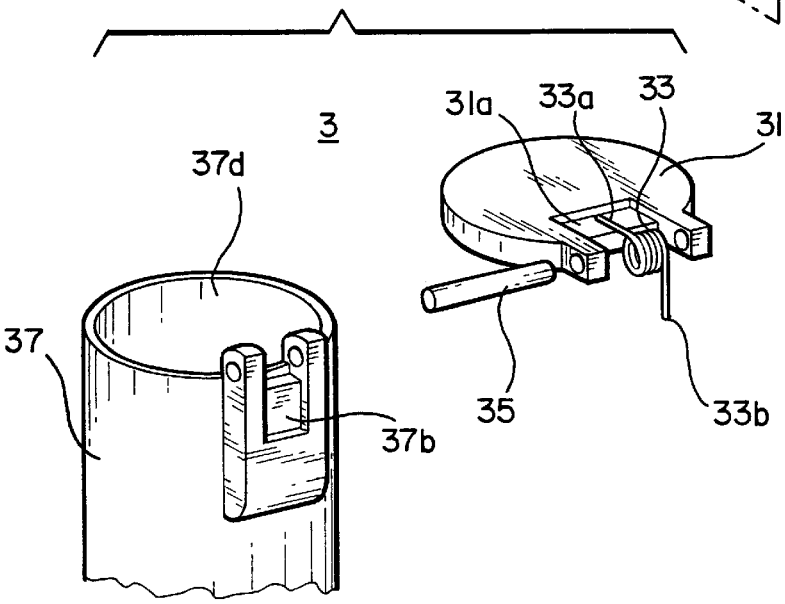

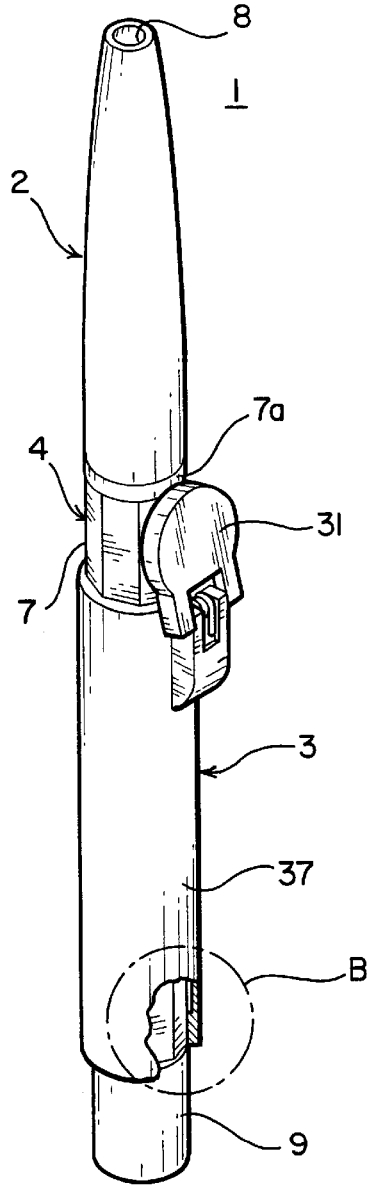
FIG. 2(A)
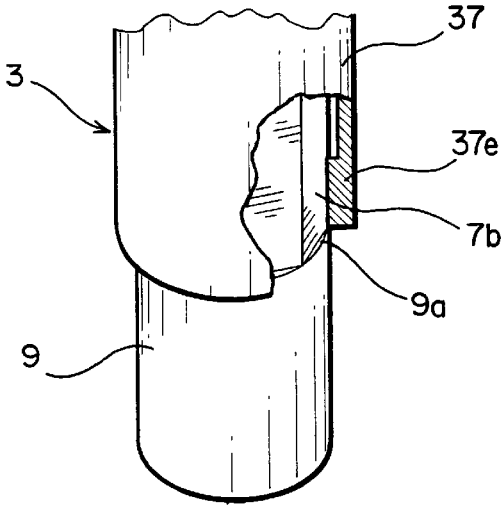
FIG. 2(B)
FIG. 5
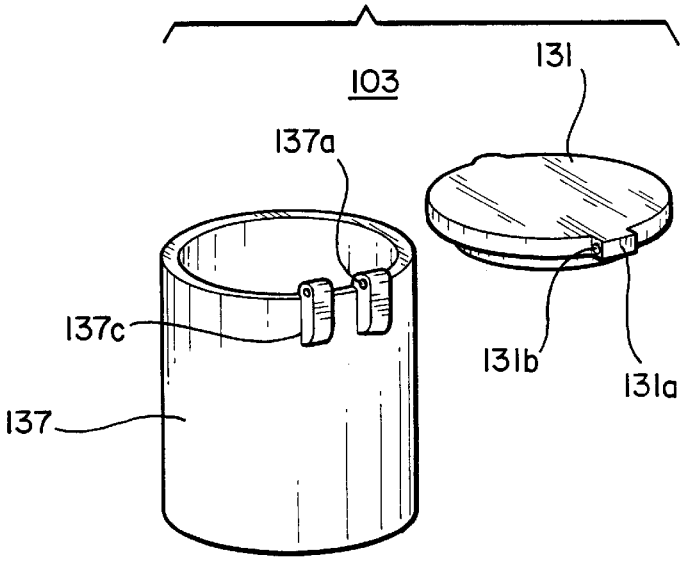

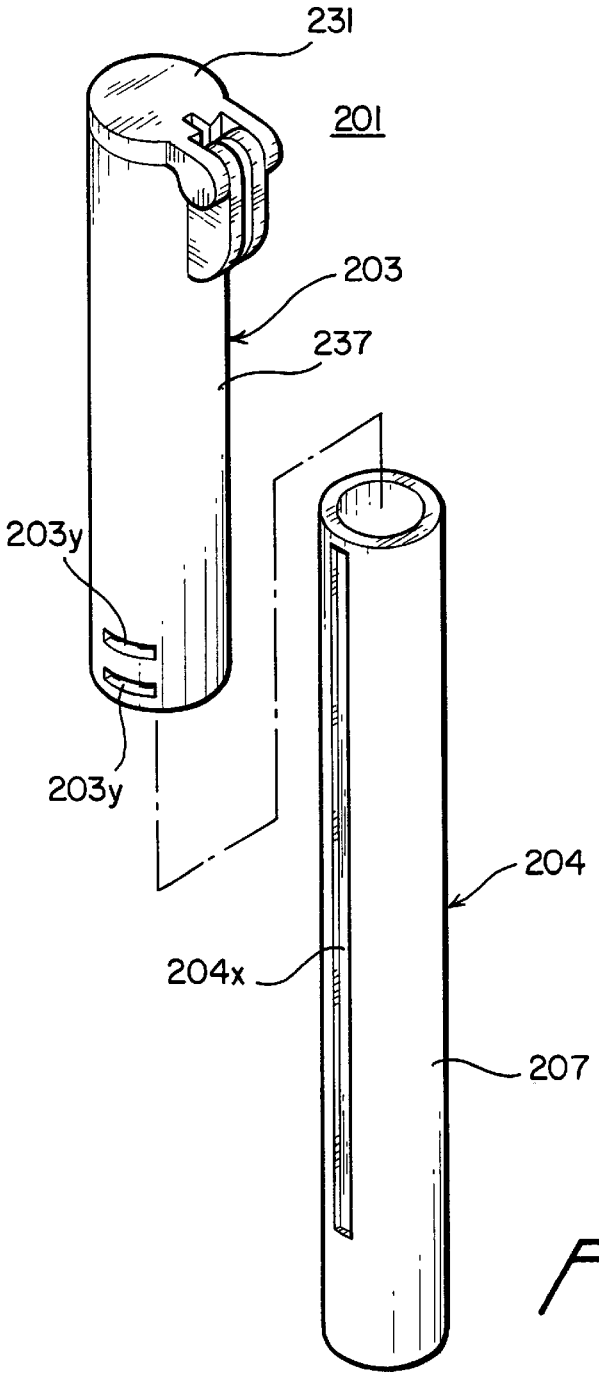
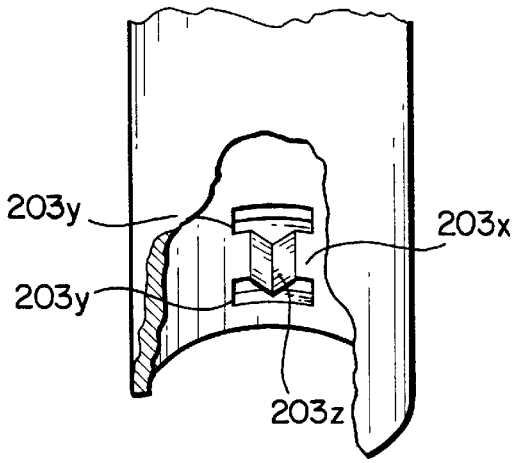
FIG. 6(B)
FIG. 6(A)

CARTRIDGE TYPE BAR-SHAPED COSMETIC MATERIAL DELIVERY CONTAINER

TECHNICAL FIELD

The present invention relates to a cartridge type container for feeding a stick type cosmetic material which houses a stick type cosmetic material, such as eyeliner or lipstick, in such a manner that the material can be fed.

BACKGROUND ART

Generally, a cartridge type container for feeding a stick type cosmetic material is composed of a cartridge and a container body. Thus, even though a stick type cosmetic material built in the cartridge is completely used up, the same container body can successively be used by replacing the cartridge with a new cartridge. Further, a single container body can be used for a various colors or shapes of stick type cosmetic materials by replacing a cartridge attached to the container body with another cartridge which has a different color or shape of stick type cosmetic material within.

Incidentally, it is necessary for a stick type cosmetic material, such as eyeliner or lipstick, to be kept clean. Thus, a cartridge type container for feeding a stick type cosmetic material is provided with a cap which covers an opening of the cartridge to be used for feeding the stick type cosmetic material.

However, in the case of a cartridge type container for feeding a stick type cosmetic material having such a cap, it requires much labor for replacing a cartridge. More specifically, when the cartridge is replaced, it is necessary to carry out the following processes: first, the cap is detached, the cartridge is then extracted, further, a new cartridge is installed, and finally, the cap is attached. This is troublesome. Further, it is likely to lose the cap during the replacing work.

The present invention is made in consideration of such problems. An object of the present invention is to provide a cartridge type container for feeding a stick type cosmetic material having a cap to maintain the stick type cosmetic material clean which facilitates the cartridge replacing work.

Further, another object of the present invention is to provide a cartridge type container for feeding a stick type cosmetic material which can prevent the loss of a cap by taking measures to prevent the cap to maintain the cosmetic material clean from coming off the container body.

Further, another object of the present invention is to provide a cartridge type container for feeding a stick type cosmetic material having a cap to maintain the stick type cosmetic material clean which is applicable to various types of feeding and returning mechanisms.

DISCLOSURE OF THE INVENTION

According to the present invention, a cartridge type container for feeding a stick type cosmetic material is provided with a cartridge having a stick type cosmetic material within and a container body which can easily be attached to and detached from the cartridge, wherein the stick type cosmetic material in the cartridge is advanced or returned by relatively rotating the container body and the cartridge in a state that the cartridge is attached to the container body, the cartridge type container further comprising a cap which is composed of a cylinder attached to a periphery of the container body in a manner that the cylinder can slide in an axial direction and never comes off and a lid which is installed at the cylinder and can easily open and close an upper end opening of the cylinder. Due to such constitution, when the cartridge is replaced, the cylinder of the cap can be slid in advance to a position where replacing work will not be interfered, thereby facilitating the replacing work of the cartridge. Further, the cap never comes off the container body, whereby a loss of the cap will not occur during the replacing work of the cartridge.

Further, according to the present invention, on an outside surface of the container body mentioned above, there are provided an upper side stopper section to define an uppermost sliding limit of the cylinder and a lower side stopper section to define a lowermost sliding limit of the cylinder are provided on an outside surface of the container body, respectively, and also an upper side contact section which comes into contact with the upper side stopper section at the uppermost sliding limit of the cylinder and a lower side contact section which comes into contact with the lower side stopper section at the lowermost sliding limit are provided on an inside surface of the cylinder, respectively. Thus, it is possible to simply and reasonably constitute a mechanism which defines the uppermost and lowermost sliding limits of the cylinder and makes it impossible for the cylinder to come off the container body.

Further, according to the present invention, the lid can be closed at least at the uppermost sliding limit of the cylinder and also the lid is pushed open by sliding the cylinder downward. Thus, it is possible to prevent dust from entering through an opening provided at an upper end of the cartridge or an opening provided at an upper end of the container body while the cartridge is removed. Also, the lid is opened only by sliding the cylinder downward, whereby the stick type cosmetic material can be used or the replacing work of the cartridge can immediately be carried out.

Further, the present invention is constituted so that at the lowermost sliding limit of the cylinder, the lid has already descended to a side of the container body, so that the cartridge can be attached to the container body from an upper end opening of the cylinder. Due to such constitution, if the cylinder has been slid to the lowermost sliding limit, the lid will not interfere the replacing work of the cartridge or use of the cosmetic material.

Further, the present invention is provided with a resilient means for urging the lid to a direction of closing the upper end opening of the cylinder. Thus, the lid is automatically closed at least by sliding the cylinder up to the uppermost sliding limit, whereby the cartridge type container for feeding a stick type cosmetic material can be user-friendly.

Further, the present invention is constituted so that the resilient means for urging the lid to a direction of closing the upper end opening of the cylinder are provided, and also at the lowermost sliding limit of the cylinder, the lid has already descended to a side of the container body, so that the cartridge can be attached to the container body from an upper end opening of the cylinder. Due to the constitution, even though the cartridge is not attached to the container body, as long as the cylinder is slid up to the lowermost sliding limit, the lid does not close the upper end opening of the cylinder because the lid is at the side of the container body. Therefore, the lid will not interfere the replacing work of the cartridge.

Further, the present invention is provided with synchronous rotation means for synchronously rotating the cylinder and the container body is provided. Thus, if a user holds the cylinder and the container body and relatively rotates them, the stick type cosmetic material can be fed or returned.

Therefore, the cartridge type container for feeding a stick type cosmetic material can be user-friendly.

Further, the present invention is constituted so that the synchronous rotation means synchronously rotate the cylinder and container body no matter where the cylinder is at between the uppermost sliding limit and the lowermost sliding limit. Thus, the cap slides always straight to the container body, whereby the cartridge type container for feeding a stick type cosmetic material can be user-friendly.

BRIEF DESCRIPTION OF THE DRAWINGS

FIG. 1 is a perspective view showing constitution of parts of a cartridge type container for feeding a stick type cosmetic material according to an embodiment of the present invention.

FIG. 2 is a perspective view showing a state that a cap of the container shown in FIG. 1 has already slid to a lower end of the container. FIG. 2(A) is a general view; FIG. 2(B) is a perspective view showing details of a lower part of the cap which has already slid to the lower end.

FIG. 3 is a perspective view showing a state that a cap of the container shown in FIG. 1 has already slid to an upper end of the container.

FIG. 4 is a perspective view showing a tip of the cap of the container shown in FIG. 1.

FIG. 5 is a perspective view showing a tip of the cap.

FIG. 6 shows a cartridge type container for feeding a stick type cosmetic material according to another embodiment of the present invention. FIG. 6(A) is a perspective view showing constitution of the cap and the container body; FIG. 6(B) is a fragmentary sectional view showing details of a lower part of the cap.

BEST MODE FOR CARRYING OUT THE INVENTION

Preferred embodiments of the present invention will subsequently be described with reference to accompanying drawings.

FIGS. 1 to 4 show a cartridge type container for feeding a stick type cosmetic material according to an embodiment of the present invention. Incidentally, in each of the drawings, an upward direction is a direction of feeding a stick type cosmetic material, and a downward direction is a direction of returning the stick type cosmetic material.

Figure 3A:
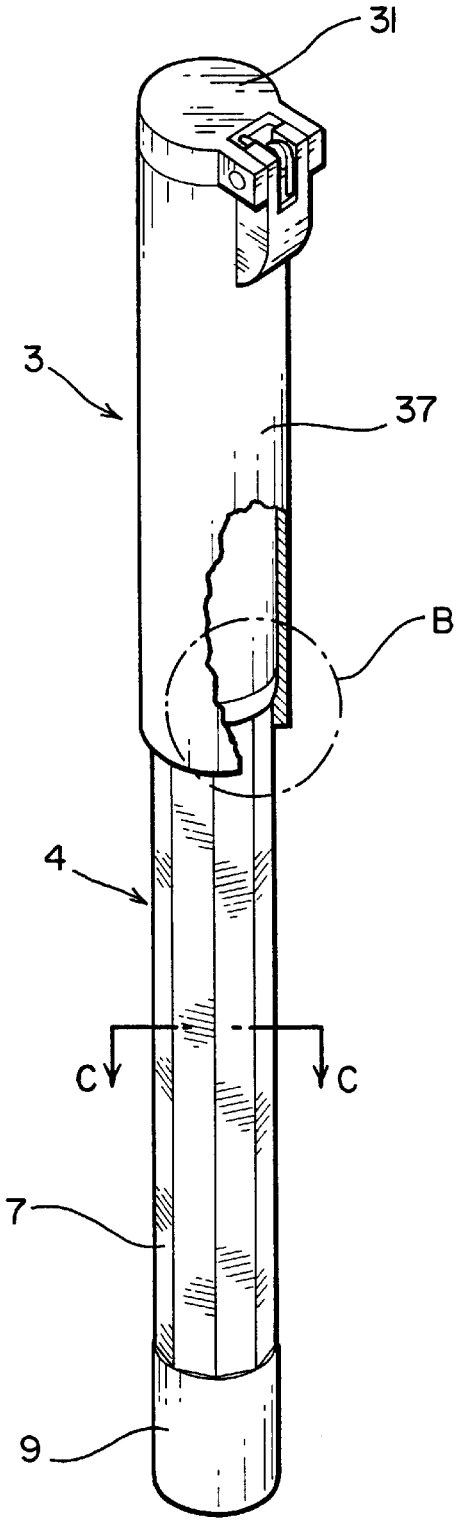
FIG. 3(A) is a general view.
Figure 3B:
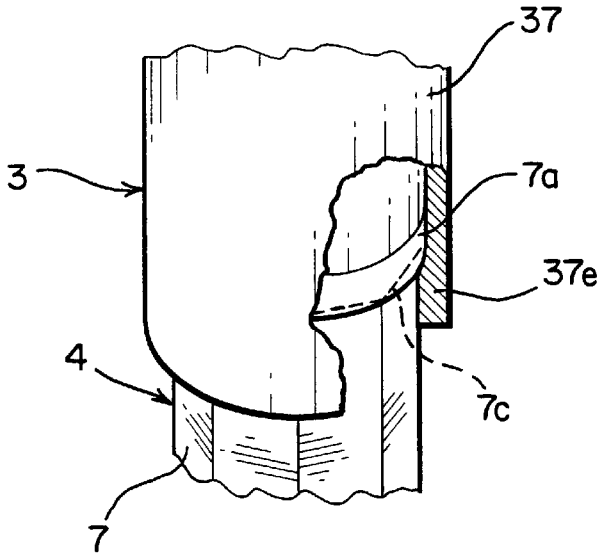
FIG. 3(B) is a perspective view showing details of a lower part of the cap which has slid to the upper end.
Figure 3C:
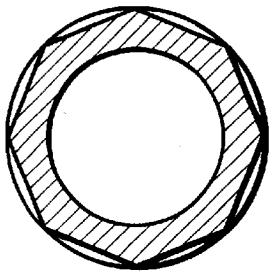
FIG. 3(C) is a sectional view taken along line C—C of FIG. 3(A).

As shown in FIGS. 1 to 3, a cartridge type 1 container for feeding a stick type cosmetic material 1' is composed of a cartridge 2, a cap 3, and a container body 4. The cartridge 2 has a stick type cosmetic material 1' within and is attached to an opening provided at an upper end of the container body 4. Incidentally, when the cartridge 2 is changed, the cartridge 2 is taken away from the upper end opening of the container body 4 and a new cartridge 2 is installed.

Figure 7:
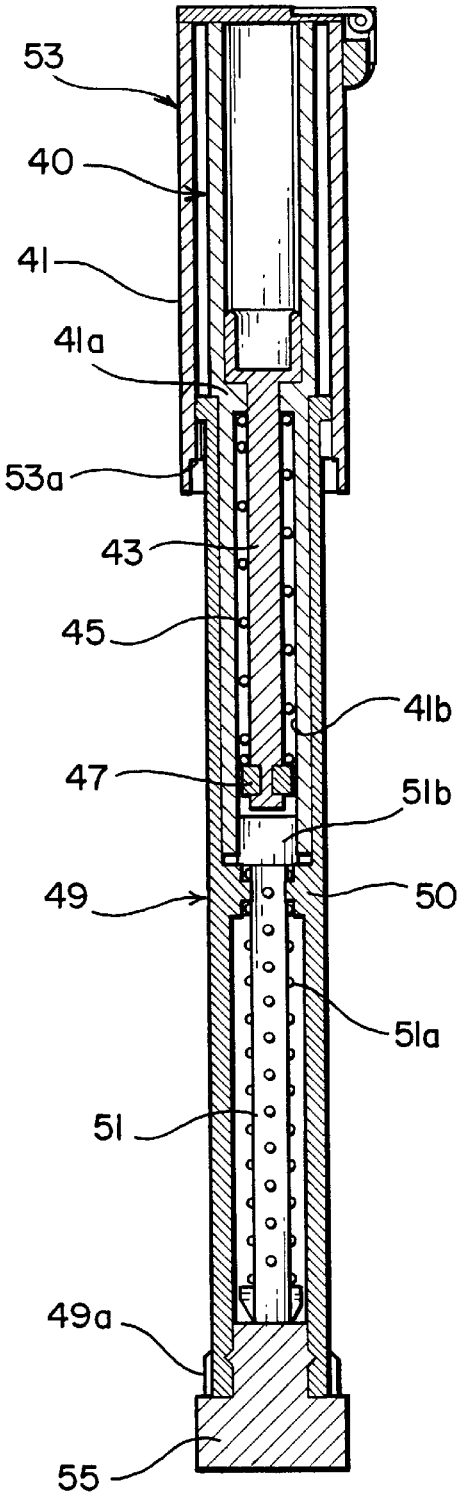
FIG. 7 shows inner structure of a cartridge type container for feeding a stick type cosmetic material according to another embodiment of the present invention.
Figure 8:
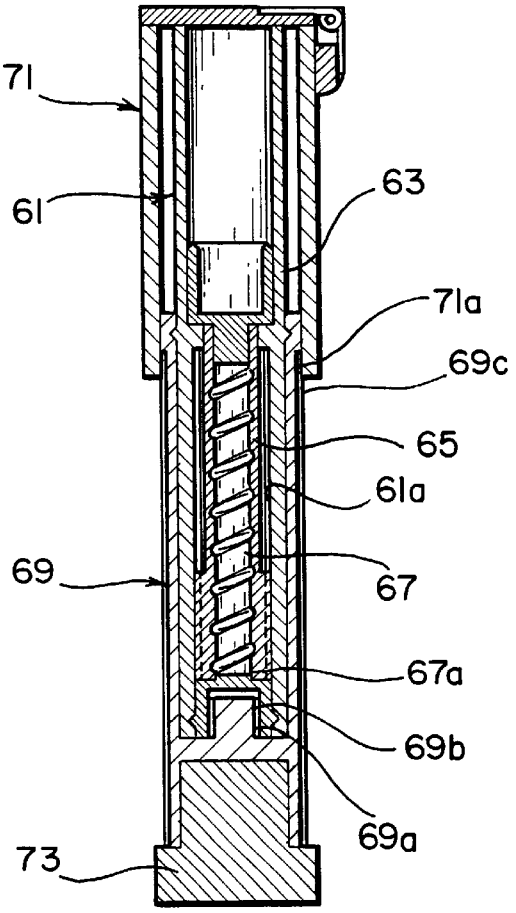
FIG. 8 is a sectional view showing inner structure of a cartridge type container for feeding a stick type cosmetic material according to another embodiment of the present invention.

In the cartridge 2 and the container body 4, a feeding and returning mechanism is provided. Thus, if the cartridge 2 and the container body 4 are relatively rotated, a stick type cosmetic material in the cartridge 2 will be fed or returned. Incidentally, a feeding and returning mechanism which is similar to the one according to the embodiment shown in FIGS. 7 and 8 is adopted, for example. Details of constitution of the feeding and returning mechanism will be described later together with each embodiment which is shown in FIG. 7 and FIG. 8.

The cap 3 is composed of a lid 31 and a hollow cylinder 37. The lid 31 is pivotally attached to the hollow cylinder 37. The cylinder 37 is slid on an outside surface of the container body 4 and holds the lid 31 in such a manner that the lid 31 can easily slide on the outside surface of the cartridge 2. The lid 31 is installed at a tip of the cylinder 37 and an upper end of the cylinder 37 can easily be opened and closed. Incidentally, details of construction of the cap 3 will be described later with reference to FIG. 4.

The container body 4 is composed of a body cylinder 7, a tail closure 9, and a feeding and returning mechanism which is built in the body cylinder 7.

The body cylinder 7 is a hollow cylindrical member. An annular flange 7*a* projecting outward is formed at an upper end opening 7*f* of the body cylinder 7. Further, a lower end opening of the body cylinder 7 is closed by the tail closure 9. Incidentally, the tail closure 9 is fixed into the lower end opening of a body cylinder 7*b* by a method, such as the tightening by a screw, concavo-convex engagement, or the like.

An outside surface of a sublevel section 7*b* of the body cylinder 7 is formed in such a manner that its section is an equilateral octagon in a longitudinal direction from a lower end of the flange 7*a* to the lower end opening. Further, outer diameters of the flange 7*a* and the tail closure 9 are equal to the outer diameter of an inscribed circle of the section of the sublevel section 7*b* which is an equilateral octagon. Therefore, as shown in FIG. 2(B) and FIG. 3(B), a step 7*c* is formed in an area of an under surface of the flange 7*a* between an outer circumference of the flange 7*a* and a side of the sublevel section 7*b*, and a step 9*a* is formed in an area of a top surface of the tail closure 9 between an outer circumference of the tail closure 9 and a side of the sublevel section 7*b*.

As shown in FIG. 2(B), a thickness 37*e* projecting inward is formed at a lower part of the cylinder 37. An inner sectional form of the thickness 37*e* is an equilateral octagon which corresponds to the sectional form of the body cylinder 7. Further, inner sectional forms of the cylinder 37 other than the thickness 37*e* are circular and the diameters are equivalent to that of a circumscribed circle of the equilateral octagon.

Due to such constitution, the cylinder 37 can slide in an axial direction of the body cylinder 7. The uppermost sliding limit and the lowermost sliding limit of the cylinder 37 are defined by steps 7*c* and 9*a* of the container body 4, respectively.

To be precise, when the cylinder 37 is slid downward along the body cylinder 7, as shown in FIG. 2, in a state that the cylinder 37 of the cap 3 is put on the body cylinder 7 of the container body 4, the under surface of the thickness 37e of the cylinder 37 comes into contact with the step 9*a* provided on the top surface of the tail closure 9. The contact point becomes the lowermost sliding limit of the cylinder 37. Thus, the cylinder 37 cannot slide downward anymore, whereby the cap 3 is prevented from coming off the body cylinder 7 downward.

On the other hand, as shown in FIG. 3, when the cylinder 37 is slid upward along the body cylinder 7, the top surface of the thickness 37*e* comes into contact with the step 7*c* provided on the under surface of the flange 7*a* of the body cylinder 7. The contact point becomes the uppermost sliding limit of cylinder 37. Thus, the cap 3 is prevented from coming off so as not to fall out upward from the body cylinder 7.

Further, since the cylinder 37 slides in such a manner, the lid 31 slides along the outside surface of the cartridge 2. When the cylinder 37 reaches the lowermost sliding limit, the lid 31 is completely shifted to the container body 4 side as shown in FIGS. 1 and 2.

Thus, as shown in FIG. 2, if the cylinder 37 is slid to the lowermost sliding limit, it will be possible to arrange the lid 31, which is a projection to a side of the container body 4, far from a cosmetic material advancing hole 8 provided at an upper end of the cartridge 2. Therefore, when a user puts on make-up, the lid is not a hindrance to the make-up.

Further, as shown in FIG. 1, when the cartridge 2 is taken away from the container body 4 so as to change the cartridge 2 or the like, the cap 3 can completely be shifted to the container body 4 side by letting the cap 3 come down to the lowermost sliding limit. Further, if the cap 3 is slid upward when the cartridge 2 is removed from the container body 4 as described above, the lid 31 will reach the upper part of the body cylinder 7 and be closed. Therefore, an upper end opening 7*f* of the body cylinder 7 will be closed by the lid 31. Thus, it is possible to prevent dust or the like from entering through the opening 7*f* while the container body 4 is preserved without installing the cartridge 2.

On the other hand, when the cylinder 37 reaches the uppermost sliding limit, the lid 31 reaches above the upper end of the cartridge 2 as shown in FIG. 3, whereby an upper end opening 37*d* of the cylinder 37 can be closed by the lid 31.

Incidentally, when the cylinder 37 slides, each inside surface of the thickness 37*e* always slides along a corresponding outside surface of the body cylinder 7. Therefore, the cylinder 37 slides straight to the axial direction of the body cylinder 7.

Further, due to such constitution as described above, the thickness 37*e* of the cylinder 37 and the sublevel section 7*b* of the body cylinder 7 which have different diameters are engaged with each other. Therefore, the cylinder 37 and the body cylinder 7 synchronously rotate.

Due to such constitution that the cap 3 (the cylinder 37) and the body cylinder 7 rotate synchronously, a stick type cosmetic material can be fed or returned by holding and relatively rotating the cartridge 2 and the cylinder 37. Thus, the container for feeding a stick type cosmetic material can be easy to handle.

On the contrary to the above, if, for example, the sublevel section 7*b* of the body cylinder 7 is a cylindrical section having a small diameter and the thickness 37*a* is put on the cylindrical section, the cylinder 37 cannot rotate synchronously with the body cylinder 7. In this case, the cylinder 37 can slide to the body cylinder 7. Further, if the under surface of the flange 7*a* and the top surface of the tail closure 9 have large diameters, the uppermost sliding limit and the lowermost sliding limit of the cylinder 37 can be defined. However, in such constitution, it is necessary to hold and rotate relatively the cartridge 2 and the tail closure 9 at the time of feeding or returning the stick type cosmetic material, whereby the container for feeding a stick type cosmetic material is difficult to handle. Therefore, it is preferable to have constitution in which the cap 3 and the body cylinder 7 synchronously rotate like this embodiment.

An assembling method of the cartridge type container for feeding a stick type cosmetic material according to this embodiment will subsequently be described. Incidentally, in the following description, a description about assembly of the feeding and returning mechanism and the like will be omitted.

When the cartridge type container for feeding a stick type cosmetic material is assembled, first, the upper end opening of the cylinder 37 is put on from the lower part of the body cylinder 7 in a state that the lid 31 of the cap 3 is opened. Then, after the cylinder 37 is completely put on the body cylinder 7, the tail closure 9 is fitted in the lower end opening of the body cylinder 7. In this state, the cartridge 2 is inserted from the upper end opening 7*f* of the body cylinder so as to be attached. Finally, the cylinder 37 is slid upward along the outside surface of the body cylinder 7. In this case, since the top surface of the thickness 37*e* of the cylinder 37 comes into contact with the step 7*c* provided on the under surface of the flange 7*a* and the cylinder 37 reaches the uppermost sliding limit, the cylinder 37 will not come off the body cylinder 7. When the cylinder 37 is at the uppermost sliding limit, the lid 31 reaches above the upper end of the cartridge 2 and is closed.

Further, when the cartridge 2 is changed, first, the cylinder 37 of the cap 3 is slid downward along the outside surface of the body cylinder 7 until the lid 31 is completely shifted to the body cylinder 7 side. In this state, the old cartridge 2 is taken away from the body cylinder 7 and a new cartridge 2 is then attached.

FIG. 4 is an perspective view showing a tip of the cap 3.

As shown in the drawing, the cap 3 is composed of the lid 31 which can easily be opened and closed and the hollow cylinder 37 which is held outside the cartridge 2 in a manner that the cylinder 37 can easily slide in an axial direction.

The lid 31 is a nearly circular plate and is held by shaft at a top end of the cylinder 37 in a manner that the lid 31 can easily be rotated. A torsion coil spring 33 is put on the center of a pin 35. An end 33*a* on one side of the torsion coil spring 33 pushes a top surface 31*a* of the lid 31 downward, and an end 33*b* on the other side comes into contact with an outside surface 37*b* of the cylinder 37. Thus, the lid 31 is always urged in a direction of closing an upper end 37*d* of the cylinder 37 by force of the torsion coil spring 33. Further, the cylinder 37 is cylindrical as a whole. The cylinder 37 is put on outside the body cylinder 7 and held in a manner that the cylinder 37 can slide along outside the body cylinder 7 in an axial direction.

Due to such constitution, if a user slides the cylinder 37 downward starting from the state shown in FIG. 3, the lid 31 will be pushed by the upper end of the cartridge 2. Thus, the lid 31 opens against the force of the torsion coil spring 33, and the cosmetic material advancing hole 8 at an upper end of the cartridge 2 is exposed outside. Afterward, if the cylinder 37 is further slid downward, the lid 31 will be urged by force of the torsion coil spring 33, and then the lid 31 will move downward along an outward form of the container covering from the cartridge 2 to the container body 4 in a state that the lid 31 is pressed against a side face of the cartridge 2 (see FIG. 2).

The cylinder reaches the lowermost sliding limit at a point that an under surface of the thickness 37*e* of the cylinder 37 comes into contact with the step 9*a* of the tail closure 9. When the cylinder 37 reaches the lowermost sliding limit, the lid 31 has already been shifted to the container body 4 side and is being pressed against the side face of the body cylinder 7 by the force of the torsion coil spring 33.

In this state, a user holds the cylinder 37 and rotates the cartridge 2. Thus, the stick type cosmetic material built in the cartridge 2 is fed. Further, if the user holds the cylinder 37 and rotates the cartridge 2 in a reverse direction when finished using the stick type cosmetic material, the stick type cosmetic material will be returned. Then, the tail closure 9 is held and the cylinder 37 is slid to the uppermost sliding limit. Thus, the lid 31 is automatically closed by the force of the torsion coil spring 33.

Incidentally, according to the embodiment shown in FIGS. 1 to 4 described above, the lid 31 is always urged toward a closing direction by the force of the torsion coil spring 33, but the present invention is not restricted to such aspect. For example, it is also preferable to adopt the fitting form as shown in FIG. 5.

To say more precisely about the form shown in FIG. 5, a cap 103 is composed of a lid 131 which can easily be opened and closed and a hollow cylinder 137. Hemispherical projections 131*b* are formed at right and left ends of a hinge section 131*a* of the lid 131. These projections 131*b* are engaged with holes 137*a* of lid supporting sections 137*c* of the cylinder 137. In such a manner, the lid 131 and the cylinder 137 are connected by a hinge. Therefore, the lid 131 is not urged by the force of a spring or the like, whereby a user opens or closes the lid 131 with his or her fingertip or the like.

Incidentally, the lid 131 and the cylinder 137 can monolithically be formed by connecting them with a hinge which is elastically deformed.

FIG. 6 shows a cartridge type container for feeding a stick type cosmetic material according to another embodiment of the present invention.

A cartridge type container for feeding a stick type cosmetic material 201 according to this embodiment is composed of a cap 203, a container body 204, and a cartridge (not shown in the drawings).

The cap 203 is composed of a lid 231 which can easily be opened and closed and a hollow cylinder 237. The cylinder 237 is put on an outside surface of the container body 204 and holds the lid 231 on an outside surface of the cartridge in a manner that the lid 231 can easily slide.

Two slits 203*y* are formed above and below at a lower part of the cylinder 237 in a direction of the circumference. A part which is sandwiched by the slits 203*y* is a bend section 203*x*. At the center of the bend section 203*x*, an engagement projection 203*z* which projects into the cylinder 237 is formed.

The container body 204 is a hollow cylinder the upper and lower sides of which are opened, and a groove 204*x* is formed on the side face of the container body 204 in a longitudinal direction. The groove 204*x* is just as wide as the above-mentioned engagement projection 203*z* can enter. The groove 204*x* extends from an upper part of the lower end of the container body 204 to a slightly lower part of the upper end.

Due to such constitution, when the cap 203 is assembled from a lower part of the container body 204, the engagement projection 203*z* of the bend section 203*x* is pressed against the outside surface of the container body 204. Thus, the bend section 203*x* is bent outward and the cap 203 is put on the container body 204. If, in this state, the engagement projection 203*z* and the container body 204 are rotated so that the engagement projection 203*z* and the groove 204*x* of the container body 204 align with each other, spring back of the bend section 203*x* to the inside of the groove 204*x* occurs and the bend section 203*x* is fitted in the groove 204*x*.

Thus, if the cylinder 237 is slid upward along the container body 204, a top surface of the engagement projection 203*z* comes into contact with an upper end surface of the groove 204*x* at the uppermost sliding limit. Thus, the cap 203 does not slide upward anymore and is prevented from coming off. Further, at the lowermost sliding limit, an under surface of the engagement projection 203*z* comes into contact with a lower end surface of the groove 204*x*. Thus, the cap 203 does not slide downward any more and therefore it is prevented from coming off. Therefore, in this embodiment, it is not necessary to have the tail closure 9 which was essential to define the lowermost sliding limit in the above-mentioned first embodiment.

FIG. 7 shows yet another embodiment of the present invention.

As shown in the drawing, a cartridge 40 is composed of a front cylinder 41, a chuck 43 which slides in the front cylinder 41, and a spring 45. A lower end of a stick type cosmetic material which is not shown in the drawing is held in the chuck 43. The spring 45 is held between a spring holding ring 47 and an under surface of a flange 41*a* which is provided at a middle section of the front cylinder 41. Thus, the spring 45 presses the chuck 43 backward (downward) so as to hold the chuck 43 in the front cylinder 41. Further, the chuck 43 and the spring 45 constitute an automatic return mechanism to return the stick type cosmetic material which has been fed forward (upward).

In the container body, a push rod 51 is provided. At a periphery of the push rod 51, a plurality of projections 51*a* arranged in a spiral are formed. Further, a spiral section 50 is installed at a body cylinder 49 of the container body. The projections 51*a* provided at a periphery of the push rod 51 are engaged in a spiral groove provided at an internal circumference of the spiral section 50.

When the cartridge 40 is attached to the body cylinder 49, the front cylinder 41 is connected with the body cylinder 49 in a manner that the front cylinder 41 can easily be rotated. Further, projections formed at an upper end 51*b* of the push rod 51 are engaged with a plurality of vertical grooves 41*b* formed on an internal circumference surface of the front cylinder 41. Thus, the front cylinder 41 and the push rod 51 are synchronously engaged with each other.

In a state that the cartridge 40 is attached to the container body as described above, the front cylinder 41 and the body cylinder 49 are relatively rotated. Thus, the push rod 51 rotates relatively to the body cylinder 49 and rises straight in the front cylinder 41. As a result, the push rod 51 pushes up the chuck 43 against the spring 45. Further, if the front cylinder 41 and the body cylinder 49 are rotated in directions opposite to each other, the push rod 51 will come down. As a result, the chuck 43 is pressed by the spring 45 and is automatically returned into the front cylinder 41 by a distance equivalent to the descent of the push rod 51.

As described above, in the container shown in FIG. 7, the push rod 51, the spiral section 50, the vertical groove 41*b*, and the like constitute a feeding and returning mechanism.

Further, according to this embodiment, the cap 53 is synchronously engaged with the container body only at the lowermost sliding limit.

To be precise, a synchronous engagement groove 53*a* is formed on a lower end internal surface of the cap 53. The synchronous engagement groove 53*a* is engaged with a synchronous engagement rib 49*a* formed on a lower end external surface of the body cylinder 49. Therefore, if the cap 53 is slid downward along a periphery of the body cylinder 49, the synchronous engagement groove 53*a* of the cap 53 will be engaged with the synchronous engagement rib 49*a* of the body cylinder 49 at the lowermost sliding limit. Further, at the lowermost sliding limit, the cap 53 comes into contact with a tail closure 55 which stops up a rear end opening of the body cylinder 49. Thus, the cap 53 is prevented from coming off backward. Further, at the lowermost sliding limit, the cap 53 has completely shifted to the body cylinder 49 side.

Due to such constitution, if the cap 53 has been slid to the lowermost sliding limit, the cosmetic material can be fed or returned also by rotating the cap 53 and the front cylinder 41 relatively to each other.

FIG. 8 shows yet another embodiment of the present invention.

As shown in the drawing, according to the embodiment, a push rod 67 is installed on the cartridge side, and only a projection 69*a* for synchronously engaging with the push rod 67 is installed on the container body side.

To be precise, the cartridge of the feeding container has a front cylinder 61, a chuck 63 which slides in the front cylinder 61, an internal thread member 65, and an external thread member on push rod 67. The internal thread member 65 and the external thread member on push rod 67 are components of the feeding and returning mechanism. The internal thread member 65 is a cylindrical member and the chuck 63 is held at an upper end of the internal thread member 65 in a manner that the chuck 63 can easily be rotated. Further, the external thread member 67 is spirally engaged with the internal thread member 65 from the lower end side.

If the cartridge is fitted in a body cylinder 69, the front cylinder 61 is connected with the body cylinder 69 in a manner that the front cylinder 61 can easily be rotated. Further, an engagement groove 67*a* of the external thread member 67 is synchronously engaged with an engagement rib 69*b* formed at a projection 69*a* of the body cylinder 69. And, if the front cylinder 61 and the body cylinder 69 are relatively rotated, the external thread member 67 which is synchronously engaged with the body cylinder 69 also rotates. Thus, the internal thread member which is spirally engaged with the external thread member 67 rises or descends along an engagement groove 61*a* of the front cylinder 61. Consequently, the chuck 63 which is retained in the internal member 65 is fed or returned.

A synchronous engagement rib 71*a* is formed on a lower end internal surface of a cap 71. Further, a synchronous engagement groove 69*c* is formed on an external surface of the body cylinder 69 extending almost overall length of the body cylinder 69. The synchronous engagement rib 71*a* is engaged with the synchronous engagement groove 69*c*. Thus, the cap 71 is synchronously engaged with the container body at every sliding position.

Further, at a lower end opening of the body cylinder 69, a tail closure 73 to stop up the opening is installed. Thus, when the cap 71 slides downward along a periphery of the body cylinder 69, the cap 71 comes into contact with an upper surface of the tail closure 73. The contact point becomes the lowermost sliding limit of the cap 71 and it is prevented the cap 71 from coming off downward. Incidentally, at the lowermost sliding limit of the cap 71, the cap 71 has completely shifted to the body cylinder 69 side.

Due to such constitution, even when the cap 71 is slid halfway along the body cylinder 69, the cosmetic material can be fed or returned by relatively rotating the cap 71 and the front cylinder 61. Further, if a synchronous engagement section (the synchronous engagement groove 69*c*) of the body cylinder 69 and the cap 71 extends from the uppermost sliding limit to the lowermost sliding limit of the body cylinder 69 like the embodiment shown in FIG. 8 (or the embodiment shown in FIGS. 1 to 4 or the embodiment shown in FIG. 6), the cap 71 will rise and descend straight along the body cylinder 69. Therefore, the cartridge type container for feeding a stick type cosmetic material can be easier to handle.

As described above, the present invention is applicable to both the feeding and returning mechanism in which "a relative rotation of the cartridge and the container body advances or returns the push rod on the container body side, whereby the stick type cosmetic material in the cartridge is fed or returned" according to the embodiment shown in FIG. 7 and the feeding and returning mechanism which "is built in on the cartridge side and in which the container body does not contain any push rod and the container body and cartridge are rotatably connected by fitting the cartridge in the container body" according to the embodiment shown in FIG. 8.

Incidentally, the present invention is not restricted to a concrete aspect of each of the embodiments described above and various modifications are possible. For example, it is possible to adopt various types of mechanisms for defining the uppermost sliding limit and the lowermost sliding limit of a cap (cylinder) or mechanisms for synchronously engaging the cap and a container body. Further, shapes of a lid and a cylinder of the cap and connecting methods of the both are diversified. Therefore, in consideration of a use, design, and a method of decoration, a flexible cap can be provided.

INDUSTRIAL APPLICABILITY

As described above, the cartridge type container for feeding a stick type cosmetic material according to the present invention is a useful container for a stick type cosmetic material, such as eyeliner and lipstick. Particularly, it is suitable for facilitating the replacing work of a cartridge in a cartridge type container for feeding a stick type cosmetic container which maintains a stick type cosmetic material clean by means of a cap.

What is claimed is:

1. A cartridge type container for feeding a stick type cosmetic material, comprising:

a cartridge having a stick type cosmetic material within;

a container body which can easily be attached to and detached from the cartridge, wherein the stick type cosmetic material in the cartridge is advanced or returned by relatively rotating the container body and the cartridge in a state that the cartridge is attached to the container body; and a cap which is composed of a cylinder attached to an outer periphery of the container body in a manner that the cylinder can slide in an axial direction and never comes off and a lid which is pivotally connected to the cylinder, wherein when said cylinder is slid in a first direction, said lid is caused to pivot to an open position thereby opening an upper end opening of the cylinder, and when said cylinder is slid in a second direction, said lid is caused to pivot to a closed position in which said lid lays across to close the upper end opening of the cylinder.

2. The cartridge type container for feeding a stick type cosmetic material according to claim 1, wherein an upper side stopper section to define an uppermost sliding limit of the cylinder and a lower side stopper section to define a lowermost sliding limit of the cylinder are provided on an outside surface of the container body, respectively, and also an upper side contact section which comes into contact with the upper side stopper section at the uppermost sliding limit of the cylinder and a lower side contact section which comes into contact with the lower side stopper section at the lowermost sliding limit are provided on an inside surface of the cylinder, respectively.

3. The cartridge type container for feeding a stick type cosmetic material according to claim 1, wherein the lid can be closed at least at the uppermost sliding limit of the cylinder and also the lid is pushed open by sliding the cylinder downward.

4. The cartridge type container for feeding a stick type cosmetic material according to claim 3, wherein at the lowermost sliding limit of the cylinder, the lid has already descended to a side of the container body, so that the cartridge can be attached to the container body from an upper end opening of the cylinder.

5. The cartridge type container for feeding a stick type cosmetic material according to claim 3, wherein resilient means for urging the lid to a direction of closing the upper end opening of the cylinder is provided.

6. The cartridge type container for feeding a stick type cosmetic material according to claim 3, wherein resilient means for urging the lid to a direction of closing the upper end opening of the cylinder are provided, and also at the lowermost sliding limit of the cylinder, the lid has already descended to a side of the container body, so that the cartridge can be attached to the container body from an upper end opening of the cylinder.

7. The cartridge type container for feeding a stick type cosmetic material according to claim 1, wherein synchronous rotation means for synchronously rotating the cylinder and the container body are provided.

8. The cartridge type container for feeding a stick type cosmetic material according to claim 7, wherein the synchronous rotation means synchronously rotate the cylinder and the container body no matter where the cylinder is at between the uppermost sliding limit and the lowermost sliding limit.

* * * * *